United States Patent [19]

Calkin et al.

[11] Patent Number: 4,461,104

[45] Date of Patent: Jul. 24, 1984

[54] REMOVABLE WALKING ATTACHMENT FOR SKI BOOTS

[75] Inventors: Carston R. Calkin, Portland; Pasqualle Trotti, Tigard, both of Oreg.

[73] Assignee: Skedco, Inc., Portland, Oreg.

[21] Appl. No.: 390,068

[22] Filed: Jun. 18, 1982

[51] Int. Cl.[3] ..... A43B 5/00; A43D 5/00

[52] U.S. Cl. ..... 36/132; 12/120.5

[58] Field of Search ..... 36/117, 132, 136; 12/120.5

[56] References Cited

U.S. PATENT DOCUMENTS 4,090,278 5/1978 Olivieri ..... 36/50

4,228,602 10/1980 Groves ..... 36/132

FOREIGN PATENT DOCUMENTS 2617257 1/1977 Fed. Rep. of Germany ..... 36/132

*Primary Examiner*—Patrick D. Lawson

*Attorney, Agent, or Firm*—Oliver D. Olson

[57] ABSTRACT

A conventional ski boot is provided with a walking attachment configured as a removable, curved sole arranged with toe and heel straps configured to be clipped over the front and rear ledges of the boot, the deepest portion of the curved sole being located under the ball of the foot for allowing the foot to rock rearward, thus enabling the leg to be straightened at the knee for normal walking.

4 Claims, 7 Drawing Figures

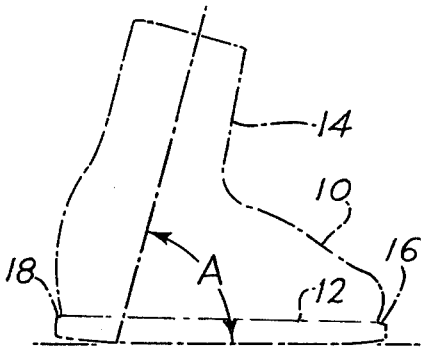
FIG. 3
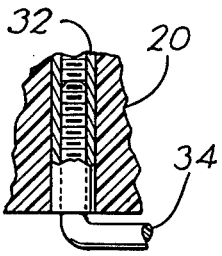
FIG. 7
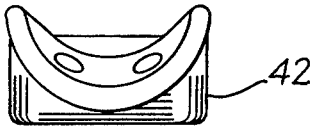
FIG. 6
FIG. 4
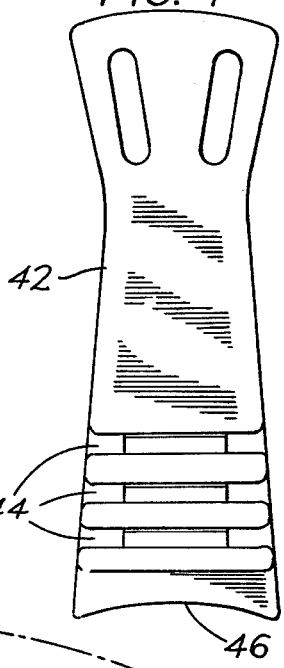
FIG. 5
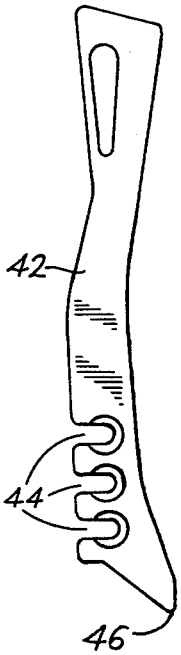
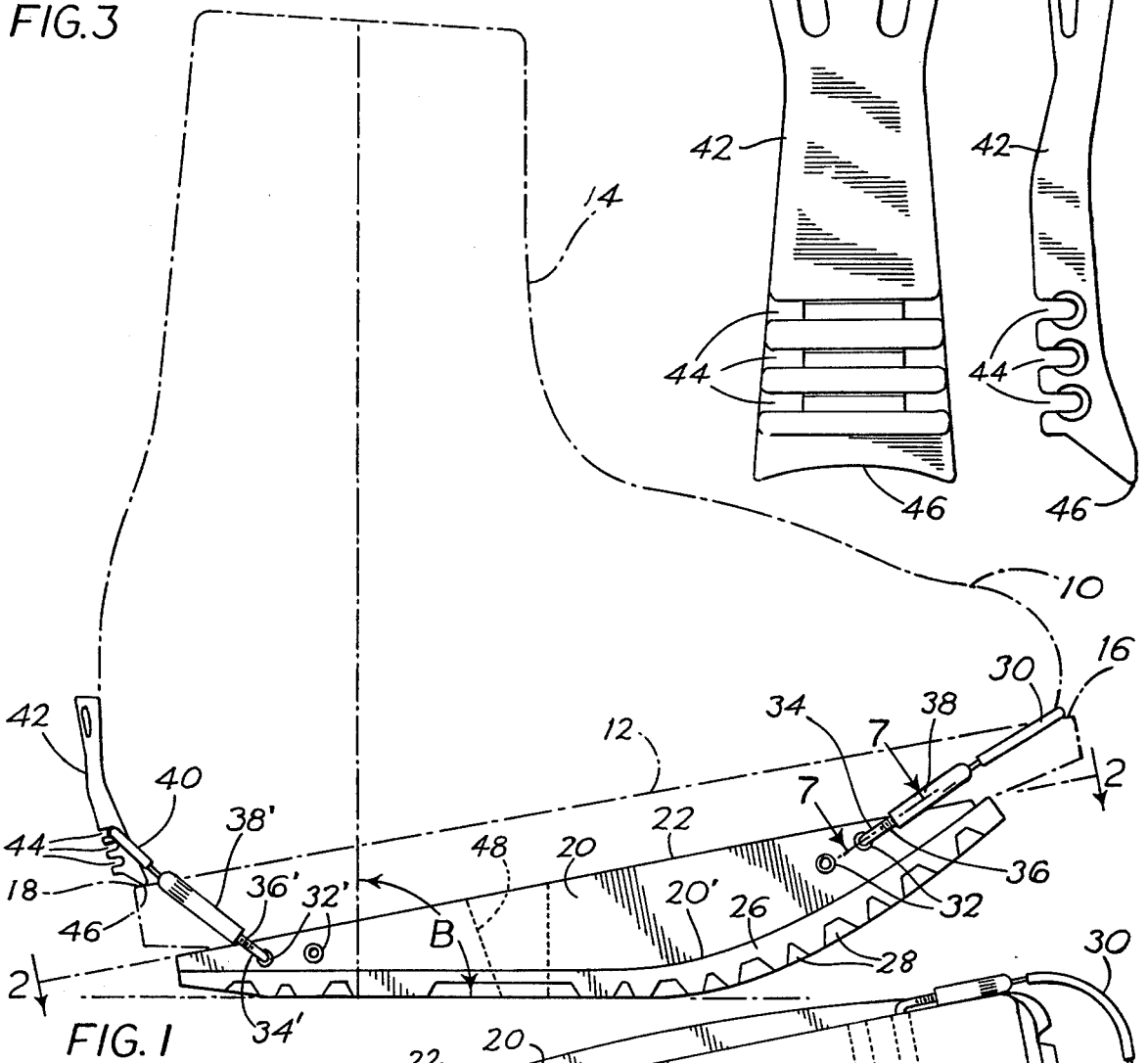
FIG. 1
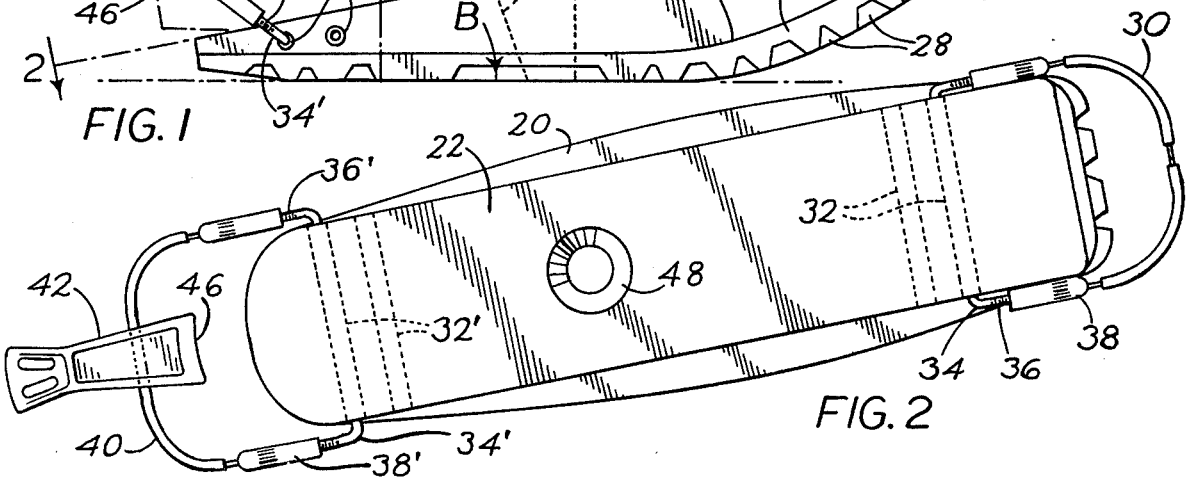
FIG. 2

REMOVABLE WALKING ATTACHMENT FOR SKI BOOTS

BACKGROUND OF THE INVENTION

This invention relates to ski boots, and more particularly to a walking device arranged for removable mounting to a conventional ski boot to facilitate normal walking.

A modern ski boot is configured as a rigid, substantially inflexible boot with a flat sole arranged for cooperation with the top flat surface of a snow ski. The sole includes front and rear projecting ledge portions arranged for releasable engagement by toe and heel pieces, respectively, of a ski binding mechanism arranged to securely mount the boot removably to a ski during use.

In order to establish the correct skiing posture in which the knees are slightly bent while the upper body is disposed substantially perpendicular to the ground, the upper portion of a ski boot is configured to extend angularly forward at the ankle, thus requiring that the skier's knees be bent in order for him to assume an upright position.

Because of this inflexible construction which requires that a skier's knees be bent while in the boots, and because the sole of the boot does not bend, walking in ski boots is difficult, cumbersome and tiring. Also, particularly with modern ski boot and binding configurations, any wearing of the sole caused by walking on ground surfaces eventually destroys the necessary heel, toe and sole configuration required for correct engagement of the boot by the ski binding, and may thereby cause improper functioning of the bindings which can result in serious injury to the user.

Since the primary function of a ski boot is for attachment to and operation with a snow ski, its construction is not intended to accommodate normal walking after removal from skis. Therefore, in ordinary use in walking after skiing, it is common that a skier will release the upper, ankle supporting buckles of the boot in order to allow the leg to move independently within the rigid boot. However, this tends to break down the integrity of the upper boot portions, and often results in chafing and blistering of the leg and heel.

Various devices have been proposed to alleviate some of these problems. U.S. Pat. No. 3,971,144 discloses a ski boot modified to mount a walking sole for pivotal movement about the axis of a permanent heel mount. The walking sole is thus arranged for swinging movement between an operative position disposed under the sole of the boot and an inoperative, stored position vertically along the rear of the boot being held in such position by an ankle strap.

U.S. Pat. No. 3,775,875 discloses a binding plate protector and walking aid arranged for use specifically in conjunction with Spademan-type ski bindings. A block of protective material is configured for removable attachment to the boot binding plate which is fixed permanently to the sole of a ski boot in vertical alignment with the shinbone. The block thus supports the boot above ground, protecting the binding plate against damage and protecting the floor and furniture against damage by the binding plate.

U.S. Pat. Nos. 4,155,179 and 4,194,319 disclose ski boots which include specially constructed soles arranged with spring loaded hinged portions that can be moved between a position for use of the boots for skiing and a position for walking after removal from the skis.

SUMMARY OF THE INVENTION

In its basic concept, this invention provides a curved sole attachment arranged for removable connection to the flat sole of a conventional ski boot, and configured with the deepest point of the curved sole located under the ball of the foot.

It is by virtue of this basic concept that the principal objective of this invention is achieved; namely, the provision of a ski boot walking attachment configured for removable use with conventional, unmodified ski boots and arranged to enable normal walking in the boot.

Another object of this invention is the provision of a walking attachment of the class described which utilizes the toe and heel binding ledges of a ski boot for releasably mounting the walking attachment to the boot.

Still another objective of this invention is to provide a walking attachment of the class described which is adjustable to accommodate attachment to ski boots of various sizes and styles.

Another object of this invention is the provision of a walking attachment of the class described which is configured so that substantially the full length of the ski boot sole is covered by and hence protected by the walking attachment.

A further object of this invention is the provision of a walking attachment of the class described which is of simplified construction for economical manufacture and simplicity of operation and mounting.

The foregoing and other objects and advantages of this invention will appear from the following detailed description, taken in connection with the accompanying drawings of a preferred embodiment.

BRIEF DESCRIPTION OF THE DRAWING

FIG. 1 is a side elevation of the walking attachment of this invention mounted to the sole portion of a conventional ski boot.

FIG. 2 is a plan view of the walking attachment of this invention, as viewed from the line 2—2 in FIG. 1, the heel attaching mechanism shown in released condition.

FIG. 3 is a side elevation of a conventional ski boot disposed on a ground surface, the broken lines indicating the acute angular relationship A of a skier's leg relative to the ground surface when captured within the confines of the boot.

FIG. 4 is a front elevation of the heel clip of the heel attaching mechanism of the embodiment of FIG. 1.

FIG. 5 is a side elevation of the heel clip as viewed from the right in FIG. 4.

FIG. 6 is a plan view of the heel clip as viewed from the top in FIG. 4.

FIG. 7 is a fragmentary section of the adjustable connector, taken on the line 7—7 in FIG. 1.

DESCRIPTION OF THE PREFERRED EMBODIMENT

A conventional ski boot includes a substantially rigid upper body portion 10 integrated with a sole 12. The sole is configured with a flat bottom side arranged for close association with the upper flat surface of a ski (not shown). The boot body also includes an upwardly extending rigid ankle portion 14 arranged to project angularly forward relative to the foot portion 10, as best illustrated in FIG. 1. The ankle portion is usually configured to be of sufficient length to extend a distance up the calf of the leg and thereby firmly secure the ankle and foot against movement.

The sole 12, usually formed of a hard rubber or synthetic plastic material, is always of very inflexible construction which is arranged to resist bending deformation under ordinary use. The sole of the boot incorporates toe and heel ledges 16 and 18, respectively, which are configured to cooperate with ski bindings (not shown) mounted to a ski. Binding mechanism is arranged to engage the top surfaces of the ledges and firmly but releasably clamp downward thereon for securing the boot releasably to the ski.

Since the foregoing inflexible construction of the boot is utilized to compel a skier to assume and maintain a skiing posture in which the knees are bent, walking in ski boots must also be done with knees unlocked. With a rigid sole, the normal bending of the foot at the ankle and at the ball of the foot is also prevented, and the resulting combination of those limitations makes mobility with ski boots extremely difficult and awkward.

The removable walking attachment of this invention includes a body 20, preferably formed of a light weight but relatively strong material such as polyurethane. It is configured with an upper flat surface 22, and a lower curved surface 24. The body is of sufficient length to extend preferably from the heel of a ski boot sole 12 to a point near the toe of the boot. As illustrated, the thickest portion 20' of the body is located approximately directly under the portion of the boot which carries the ball of the foot. The rearward portion of the body is configured with a progressively decreasing thickness so that a ski boot positioned thereon (FIG. 1) is angled downwardly at the heel. Accordingly, the ankle portion 14 extends substantially perpendicular relative to the ground surface, as indicated by the broken line, and hence the skier may comfortably assume an upright position with his knees locked.

Mounted to the lower curved surface 24 of the body 20 is a sole 26 which may be provided with treads 28, as shown, for increased traction. The sole may be formed of rubber, plastic, or any material suitable for use as boot soles, and is attached to the body 20 in any conventional manner such as glue bonding, riveting, or nailing. Alternatively, the sole 26 may be formed as an integral component of the body 20.

The walking attachment of this invention includes means arranged to attach the body 20 releasably to the front and rear binding ledges of a conventional ski boot. In the embodiment illustrated, a toe strap 30 in the form of a U-shaped bail of strong cable or other suitable flexible or rigid material is mounted to the forward portion of the body and is configured to hook over the toe binding ledge 16 of the boot and hold the toe of the boot against the forward upper surface of the body, as best shown in FIG. 1.

As best shown in FIGS. 1, 2, and 7 mounting means for the toe strap 30 includes an internally threaded anchor tube 32 provided laterally through the body 20. Each end of the tube is arranged to receive a threaded, right-angle connector 34 configured with a threaded outer portion 36 which receives the threaded end portion of a rotary adjustment coupler 38 rotatably attached to one end of the toe strap 30. Rotation of the coupler relative to the threaded portion 36 varies the combined length thereof and thus accommodates attachment of ski boots of various sizes. As illustrated, there may be provided more than one threaded tube 32 in the body spaced apart longitudinally to permit still further adjustment of the toe strap.

The tube 32 threadably engages the connector 34 so that the toe strap mounting means provides not only vertically pivotal movement of the toe strap relative to the body to accommodate ski boots of varying ledge heights, but also lateral adjustment relative to the body so as to accommodate ski boots of varying widths.

Similarly mounted to the rear portion of the body is means for securing the heel of a ski boot releasably to the body. The terminal ends of a heel strap 40, in the form of a U-shaped bail of strong cable or other material are each connected to a rotary coupler 38' which engages one end of a threaded, right-angle connector 34' mounted at its opposite end in a threaded tube 32' in the rearward portion of the body, in the same manner and for the same purpose as described previously with the toe mounting means. The heel mounting means also includes a heel clip 42 configured essentially as a longitudinally elongated member incorporating longitudinally spaced adjustment notches 44 arranged to releasably engage the heel strap 40 in a snap fit. The clip 42 includes a lower terminal end portion 46 configured for abutting contact with the heel ledge 18 of the boot.

As shown in FIG. 1, the heel strap 40 is configured to extend a spaced distance above the heel ledge 18 of the boot, and the clip 42 is arranged to provide tensioned abutment at said one end 46 with the heel ledge. The heel strap is connected to the body 20 forward of the rear end of the body, so that when the clip 42 is into tensioned engagement with the heel ledge, the heel strap moves across and is positioned forwardly of the pivoting end 46 of the clip. Thus, the clip cannot inadvertently disengage from the boot.

To engage the heel mount, the lower terminal end 46 of the clip 42 is placed centrally on the ledge 18 and the clip is rotated about its pivot end 46 as a center, to bring the upper terminal end toward the boot. The strap 40 thus snaps resiliently forward across the plane of the pivot center 46. Releasing the clip is accomplished by exerting rearward pressure on the upper terminal end portion of the clip, to rotate it rearwardly, moving the strap 40 rearwardly across the plane of the pivot center 46.

It will be apparent to those skilled in the art that various other toe and heel mounting means may be utilized to releasably secure the walking attachment to the boot through engagement of the binding ledges 16 and 18 incorporated on conventional ski boots. For example, the heel strap 40 may be non-adjustable, and hence arranged to engage a ski boot of a given size, if so desired.

The operation of the walking attachment of this invention is as follows: With a ski boot ready to receive the attachment, and the connectors 34 and 34' and couplers 38 and 38' adjusted to accommodate a boot of a particular dimension, the boot is placed with its sole on the upper flat surface 22 of the attachment body 20. The boot then is moved so the toe binding ledge 16 is captured beneath the toe strap 30 on the front of the attachment. The heel strap 40 is pivoted into position adjacent the heel of the boot and the clip 42 is positioned with its lower terminal edge 46 on the ledge 18. The clip is then rotated forward about the edge 46 as a center until the heel strap 40 snaps forward across said center. The resulting tension applied on the ledge 18 by the clip edge 46 locks the boot to the attachment. The walking attachment is thus releasably secured to the boot without any modification of the boot structure.

With the thickest area 20' of the curved sole body located beneath the ball of the foot, and the heel portion of considerably reduced thickness, the ankle portion 14 of the boot is disposed substantially perpendicular to the ground as rest position, as indicated by angle B in FIG. 1, thereby permitting a skier to stand erect with knees locked in vertical extension. As the skier shifts weight forward to take a step, the boot rocks about the thickest curved area 20' and thus permits a normal walking action, similar to a foot bending at its ball. With an inflexible ski boot provided this rocking action specifically about the ball of the foot, walking is substantially normal and releasing the boot buckles to allow movement of the ankles is not necessary.

Moreover, since the boot sole itself does not touch the ground, the sole is protected from scuffing and wearing. Also, walking in ski boots over snow and mud covered ground usually results in the accumulation of foreign matter on the sole of the ski boot, requiring the expenditure of time and effort in scraping or knocking the matter from the ski boot, in order that ski bindings may properly engage the boot. The attachment of this invention protects the sole of a ski boot from the accumulation of such material.

To remove the attachment, the clip 42 is simply snapped rearward by pivoting the upper portion of the clip outward from the boot, and the boot is lifted off of the body 20. When not in use, the walking attachment may be stored in any convenient manner on a person or elsewhere, as desired. A chain lock bore 48 is provided through the body 20 so that a lock chain (not shown) may be inserted therethrough and then locked to a post or other permanent fixture.

It will be appreciated that, by virtue of the normal walking action thus afforded with conventional ski boots by this invention, the attachment beneficially stretches the muscles and tendons from the heel up the back of the leg and thus allows the muscles to relax and relieve the strain which results from skiing and walking with bent knees.

It will be apparent to those skilled in the art that various changes, other than those already discussed may be made in the size, shape, type, number and arrangement of parts described herein without departing from the spirit of this invention and the scope of the appended claims.

Having thus described our invention and the manner in which it may be used, we claim:

1. For use with a conventional snow ski boot which includes a boot body, a sole, and toe and heel binding ledges, a removable walking attachment comprising:

(a) an elongated body having a flat top side and an curved bottom side, the body being of thickest dimension intermediate its ends in an area corresponding substantially to the position of the ball of a foot, (b) toe attaching means mounted to the forward portion of the body and configured to releasably engage the toe binding ledge of a ski boot, and (c) heel attaching means mounted to the rear portion of the body and arranged to releasably engage the heel binding lenge of a ski boot, the heel attaching means comprising:

(1) A substantially U-shaped strap secured pivotally at its free ends to the opposite sides of the body forwardly of the rear end thereof, the closed intermediate portion of the strap being spaced a predetermined fixed distance from the free ends of the strap and arranged to extend above the body a spaced distance above the heel ledge of a ski boot, and (2) an elongated heel clip connected pivotally intermediate its ends to the closed intermediate portion of the strap for pivotal movement on an axis substantially parallel to the pivot axis of the free ends of the strap, (3) one end of the heel clip being arranged to extend into the space between the free ends of the strap and the closed intermediate portion thereof for releasable abutment with the upper surface of the heel ledge of a ski boot, (4) the pivot connection of the heel clip to the closed intermediate portion of the strap being selected to allow the said one end of the heel clip to be placed in abutment with the upper surface of the heel ledge of a ski boot and the heel clip rotated forwardly about said one end as a pivot axis until the plane of the strap moves forwardly across said one end pivot axis to releasably clamp the heel clip to the back of a ski boot.

2. The walking attachment of claim 1 wherein the toe attaching means comprises a U-shaped bail arranged to hook over the toe binding ledge of a ski boot, the bail being adjustable longitudinally and laterally relative to the body to accommodate attachment of ski boots of various sizes and styles.

3. The walking attachment of claim 1 wherein the U-shaped strap of the heel attaching means comprises a U-shaped bail arranged for longitudinal and lateral adjustment relative to the body to accommodate attachment of ski boots of various sizes and styles.

4. The walking attachement of claim 1 including means on the heel clip for pivotally connecting the closed intermediate portion of the strap at any one of various distances from the said one end of the heel clip.

* * * * *